US006386101B2

(12) United States Patent
Tobe et al.

(10) Patent No.: US 6,386,101 B2
(45) Date of Patent: May 14, 2002

(54) PRINTING PRESS

(75) Inventors: Kenji Tobe; Kazuya Iyokawa, both of Chiba (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 09/858,953

(22) Filed: May 17, 2001

(30) Foreign Application Priority Data

May 17, 2000 (JP) ..... 12-144887

(51) Int. Cl.[7] ..... B41F 5/00; B41F 7/00; B41F 21/00

(52) U.S. Cl. ..... 101/216; 101/212; 101/477; 101/383

(58) Field of Search ..... 101/216, 477, 101/212, 378, 382.1, 383

(56) References Cited

U.S. PATENT DOCUMENTS 5,440,988 A * 8/1995 Ito ..... 101/477
5,511,478 A * 4/1996 Lindner et al. ..... 101/477
5,613,438 A * 3/1997 Rehberg ..... 101/216
5,649,487 A * 7/1997 Zuber ..... 101/477
5,699,734 A * 12/1997 Bitterich ..... 101/216

FOREIGN PATENT DOCUMENTS

EP 0503750 A1 9/1992
JP 4-284252 A 10/1992

* cited by examiner

*Primary Examiner*—John S. Hilten
*Assistant Examiner*—Marvin P. Crenshaw

(57) ABSTRACT

A printing press includes an L-shaped support arm swingably supported by a main frame such that a distal end thereof can move between lower and upper positions, a support frame swingably supported at the distal end of the support arm such that the other end thereof can move between upper and lower positions, swing arms swingably supported by the main frame such that the distal ends thereof can move between lower and upper positions, gas springs for applying force to the corresponding swing arms to move the distal end portions of the swing arms upward, an engagement pin attached to the support frame, and an engagement member attached to the swing arms and into which the engagement pin is inserted and has an engagement groove formed therein to open upward when the distal ends of the swing arms are situated at the upper position.

10 Claims, 11 Drawing Sheets

PRINTING PRESS

The entire disclosure of Japanese Patent Application No. 2000-144887 filed on May 17, 2000, including specification, claims, drawings and summary is incorporated herein by reference in its entirety.

BACKGROUND OF THE INVENTION

1. Field of the Invention

The present invention relates to a printing press having movable members, such as a cover and a plate-replacing device, disposed around printing means, such as various cylinders and an inking unit.

2. Description of the Related Art

In a printing press, in order to enable maintenance or inspection of printing means, such as various cylinders and an inking unit, a cover, a plate-replacing device, and like members are movably disposed around the printing means such that an open space can be established around the printing means. These movable members are very heavy and require considerable labor in moving the same.

Means for facilitating the above movement is disclosed in, for example, Japanese Patent Application Laid-Open (kokai) No. 4-284252. Specifically, a base end portion of an L-shaped arm is rotatably connected to the upper end of a frame of a printing press. An upper end portion of a vertical bar of a safety cover is rotatably connected to a distal end portion of the arm. The base end portion of the arm is rotated by means of a hydraulic cylinder to thereby raise the safety cover in a vertical condition. In this manner, the safety cover can be moved easily.

In the printing press disclosed in Japanese Patent Application Laid-Open (kokai) No. 4-284252, however, the safety cover is raised while being maintained in a vertical condition. Thus, an open space cannot be established around upper printing means, such as an inking unit and a dampening unit and therefor, there is a difficulty in maintaining or inspecting the upper printing means.

SUMMARY OF THE INVENTION

In view of the foregoing problem, an object of the present invention is to provide a printing press which facilitates movement of movable members over a wide range.

To achieve the above object, the present invention provides a printing press comprising a first movable member swingably supported by a main frame such that the first movable member can move between a first position and a second position; a second movable member swingably supported by the first movable member such that the second movable member can move between a third position and a fourth position; force application means for applying a force to the second movable member towards the fourth position; and connection means disposed between the second movable member and the force application means, adapted to connect the second movable member and the force application means when the second movable member moves between the third position and the fourth position, and adapted to disconnect the second movable member and the force application means from each other when the first movable member moves between the first position and the second position.

The printing press may comprise a swing member swingably provided on the main frame such that the swing member can move between a fifth position and a sixth position while establishing a connection between the connection means and the force application means.

In the printing press, the connection means may comprise an engagement member having an engagement groove; and an engagement pin which is engaged with the engagement groove of the engagement member.

In the printing press, the engagement pin may be attached to the second movable member, and the engagement member is attached to the swing member; and the engagement groove of the engagement member may be formed in such a manner that, when the swing member is situated at the sixth position, the engagement groove opens toward a moving direction of the first movable member from the first position to the second position.

In the printing press, the engagement pin may be attached to the swing member, and the engagement member is attached to the second movable member; and the engagement groove of the engagement member may be formed in such a manner that, when the swing member is situated at the sixth position, the engagement groove opens toward a moving direction of the first movable member from the second position to the first position.

In the printing press, the second movable member may comprise plate-replacing means for at least one of mounting of a plate onto a plate cylinder and demounting of a plate from the plate cylinder.

The printing press may comprise a first connection member provided on one of the main frame and the first movable member; and a connection pin provided on the other of the main frame and the first movable member, the connection pin being disengageably engaged with the first connection member to restrict swinging of the first movable member relative to the main frame.

The printing press may comprise a second connection member provided on one of the main frame and the second movable member; and a connection device provided on the other of the main frame and the second movable member, the connection device being disengageably engaged with the second connection member to restrict swinging of the second movable member relative to the main frame.

The printing press may comprise a support plate whose base end side is swingably connected to one of the first movable member and the second movable member, and which has an engagement hole formed at a distal end side; a connection device provided on the other of the first movable member and the second movable member, the connection device being disengageably engaged with the engagement hole of the support member to restrict swinging of the second movable member relative to the first movable member.

The printing press may comprise first connection means provided on the main frame; a support plate whose base end side is swingably connected to the first movable member, and which has second connection means at a distal end side; and third connection means provided on the second movable member, the third connection means being selectively connectable with the first connection means and the second connection means, wherein the third connection means and the first connection means are connected to each other to restrict swinging of the second movable member relative to the main frame, and the third connection means and the second connection means are connected to each other to restrict swinging of the second movable member relative to the first movable member.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Preferred embodiments of a printing press according to the present invention will next be described in detail with reference to the accompanying drawings. However, the present invention is not limited thereto.

Figure 1:
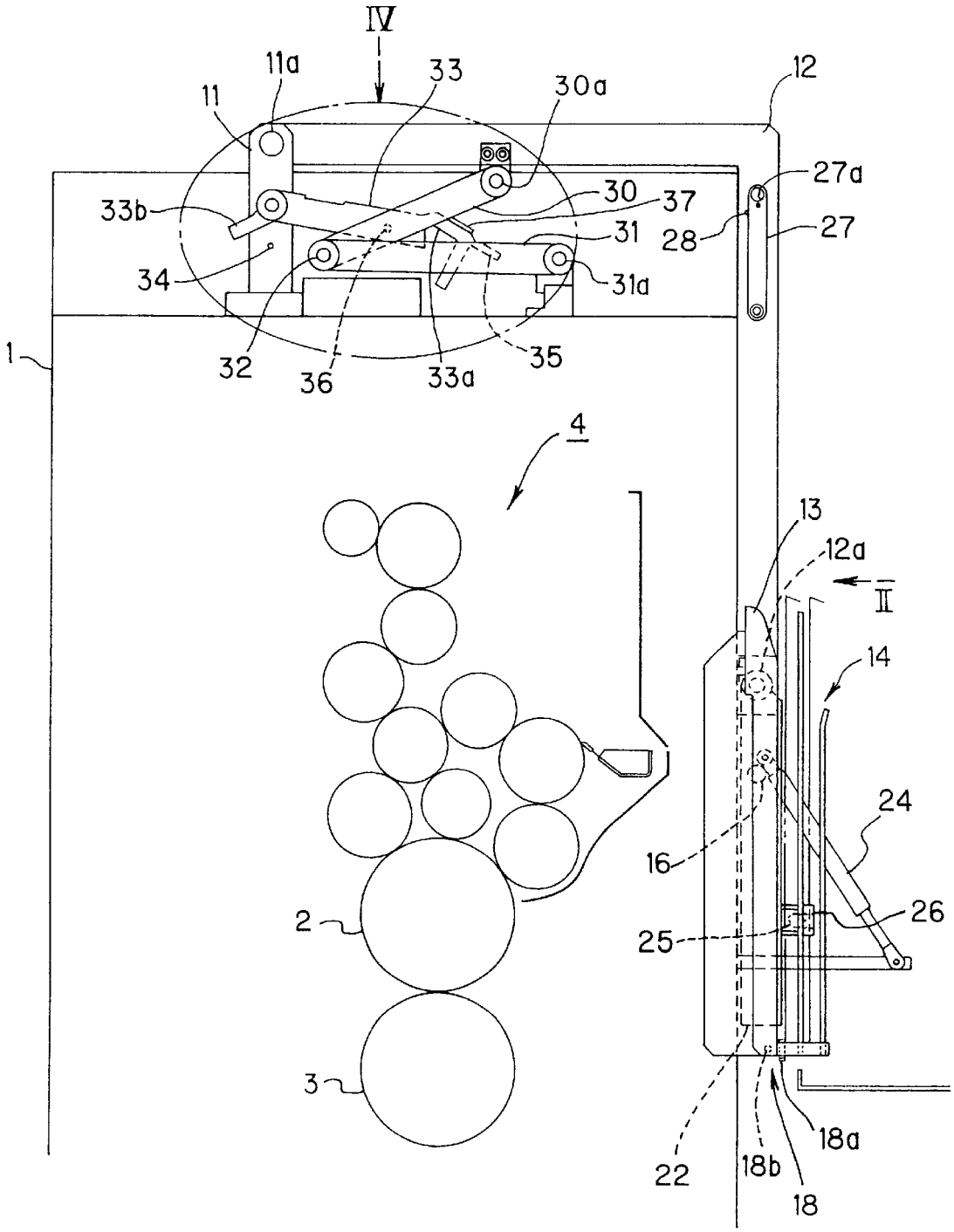
FIG. 1 is a schematic view showing a configuration of a main portion of an embodiment of a printing press according to the present invention.
Figure 2:
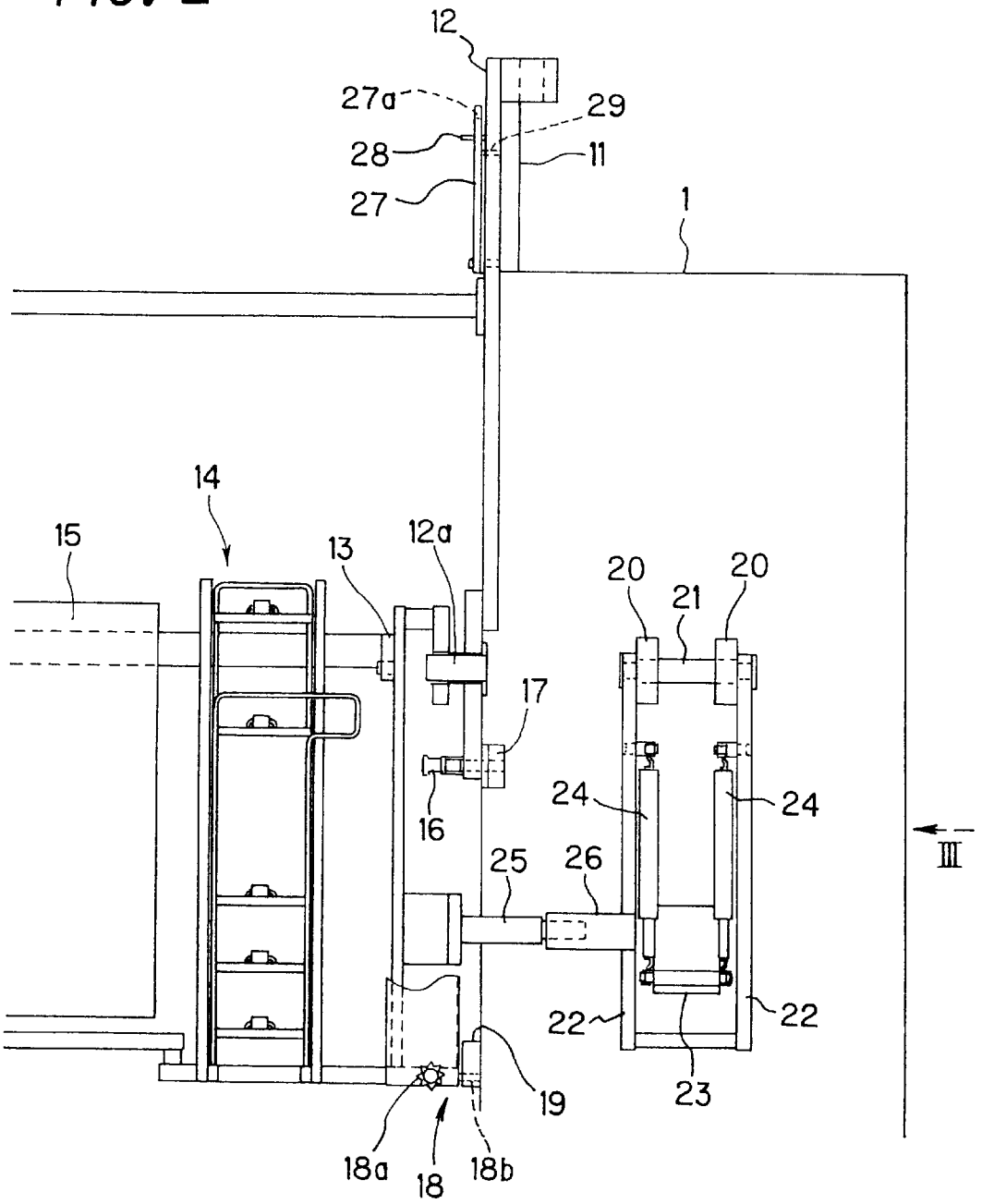
FIG. 2 is a view as viewed along the arrow II of FIG. 1.
Figure 3:
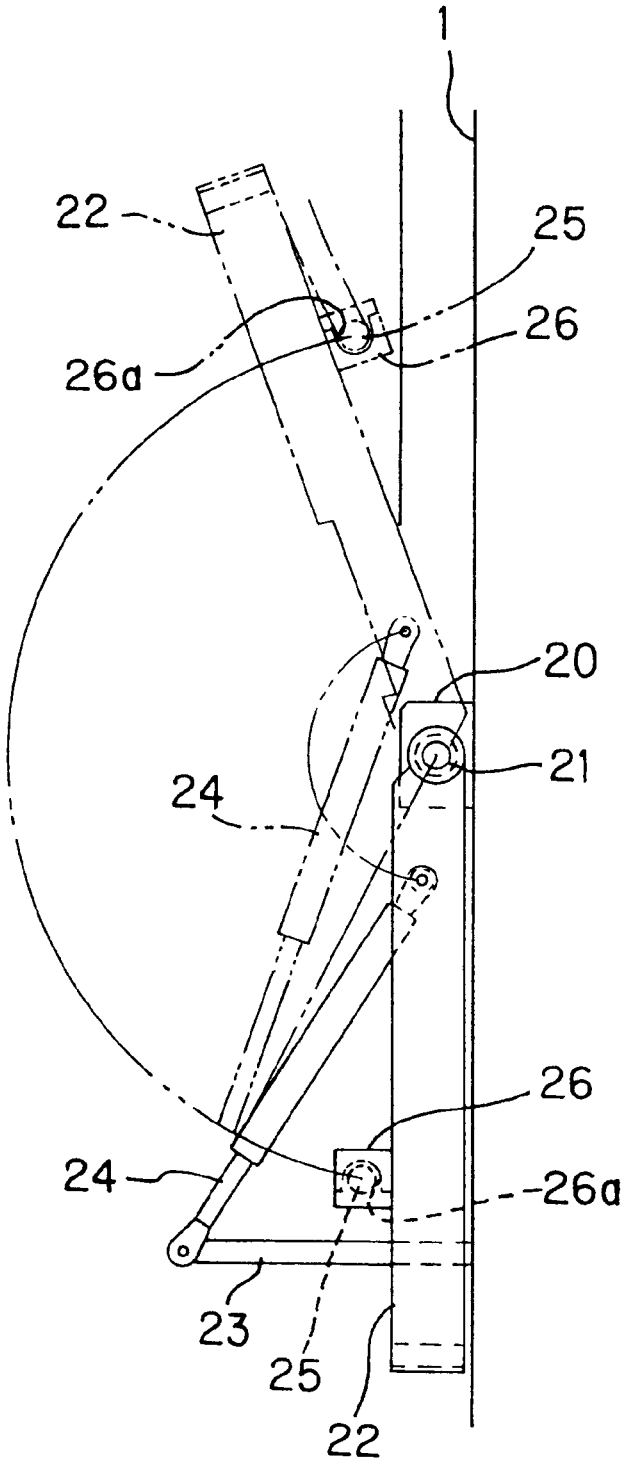
FIG. 3 is a view as viewed along the arrow III of FIG. 2.
Figure 4:
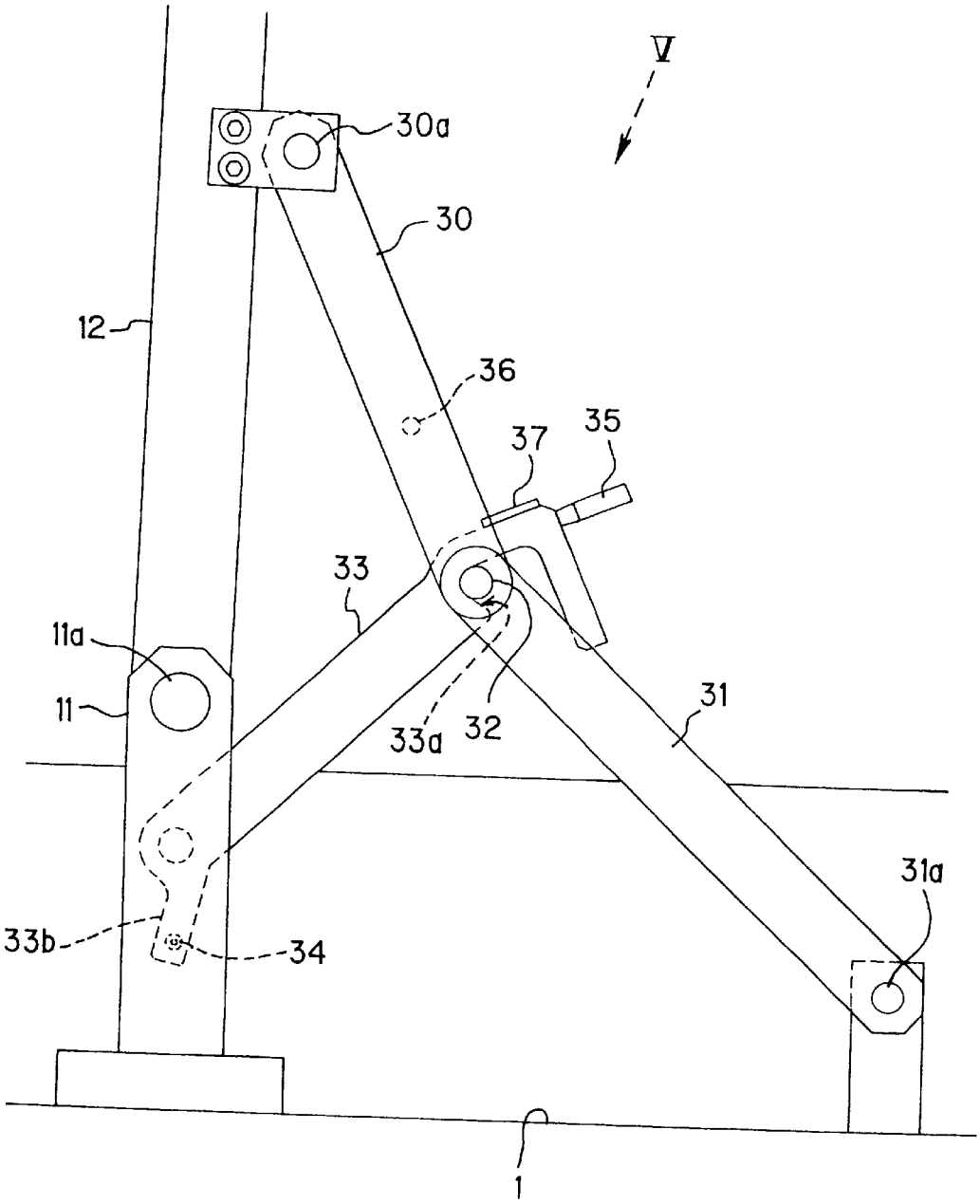
FIG. 4 is an enlarged view of a portion of FIG. 1 indicated by the arrow IV of FIG. 1.
Figure 5:
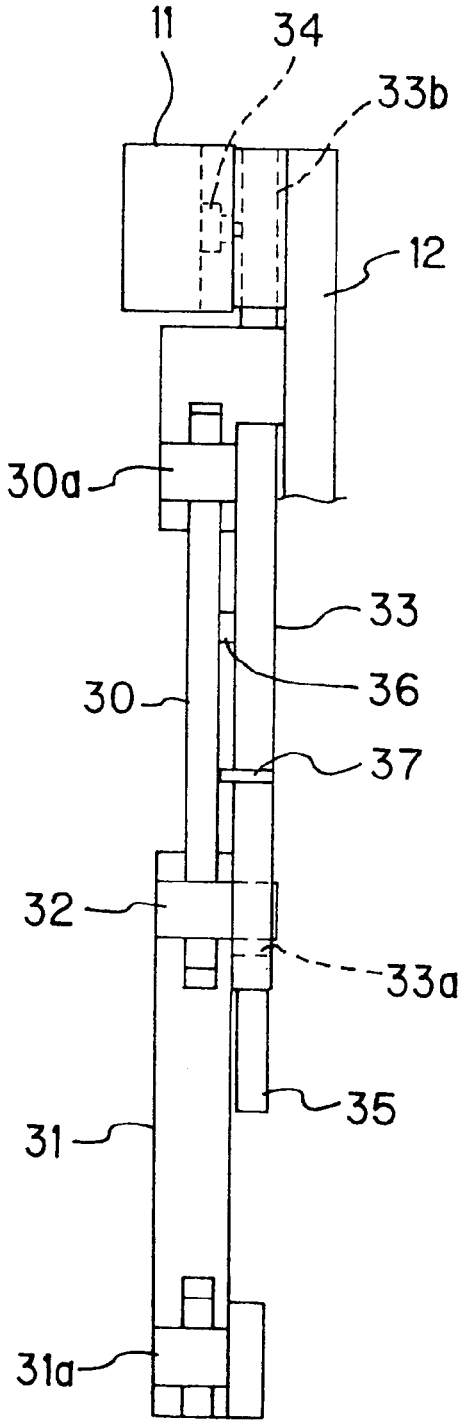
FIG. 5 is a view as viewed along the arrow V of FIG. 4.
Figure 6:
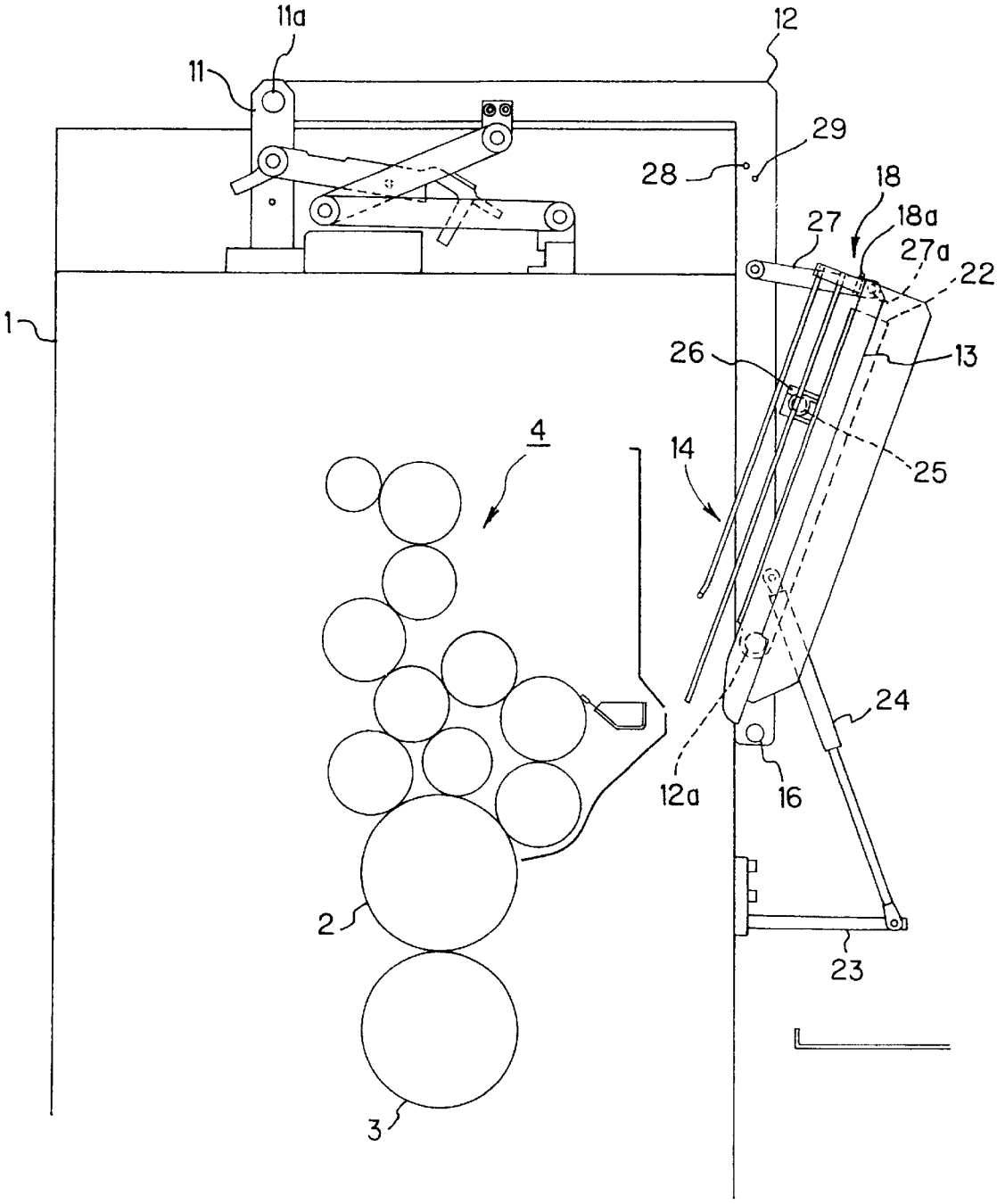
FIG. 6 is a view for explaining a case where a plate cylinder and a blanket cylinder are to undergo maintenance or inspection.
Figure 7:
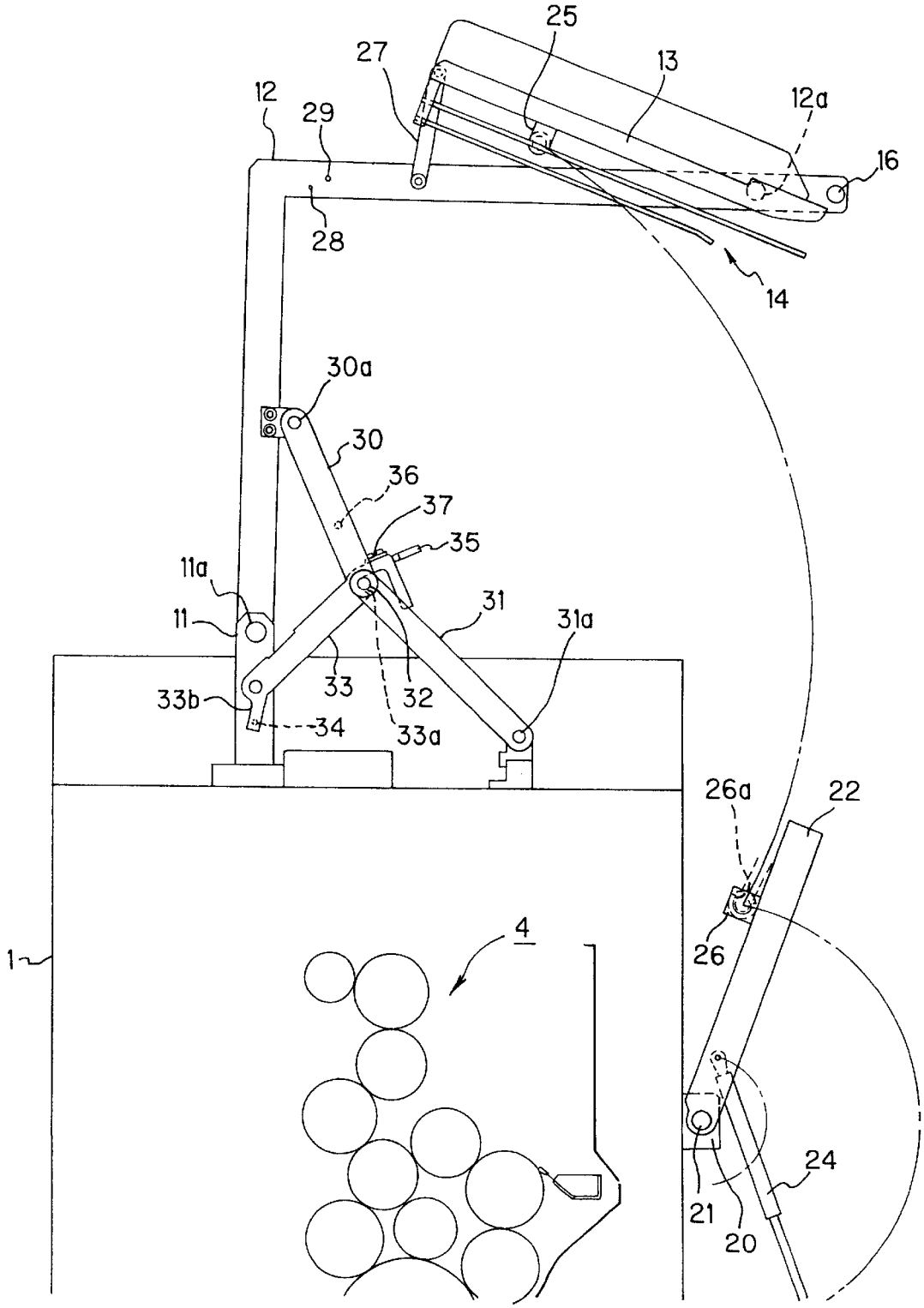
FIG. 7 is a view for explaining a case where an inking unit and a dampening unit are to undergo maintenance or inspection.
Figure 8:
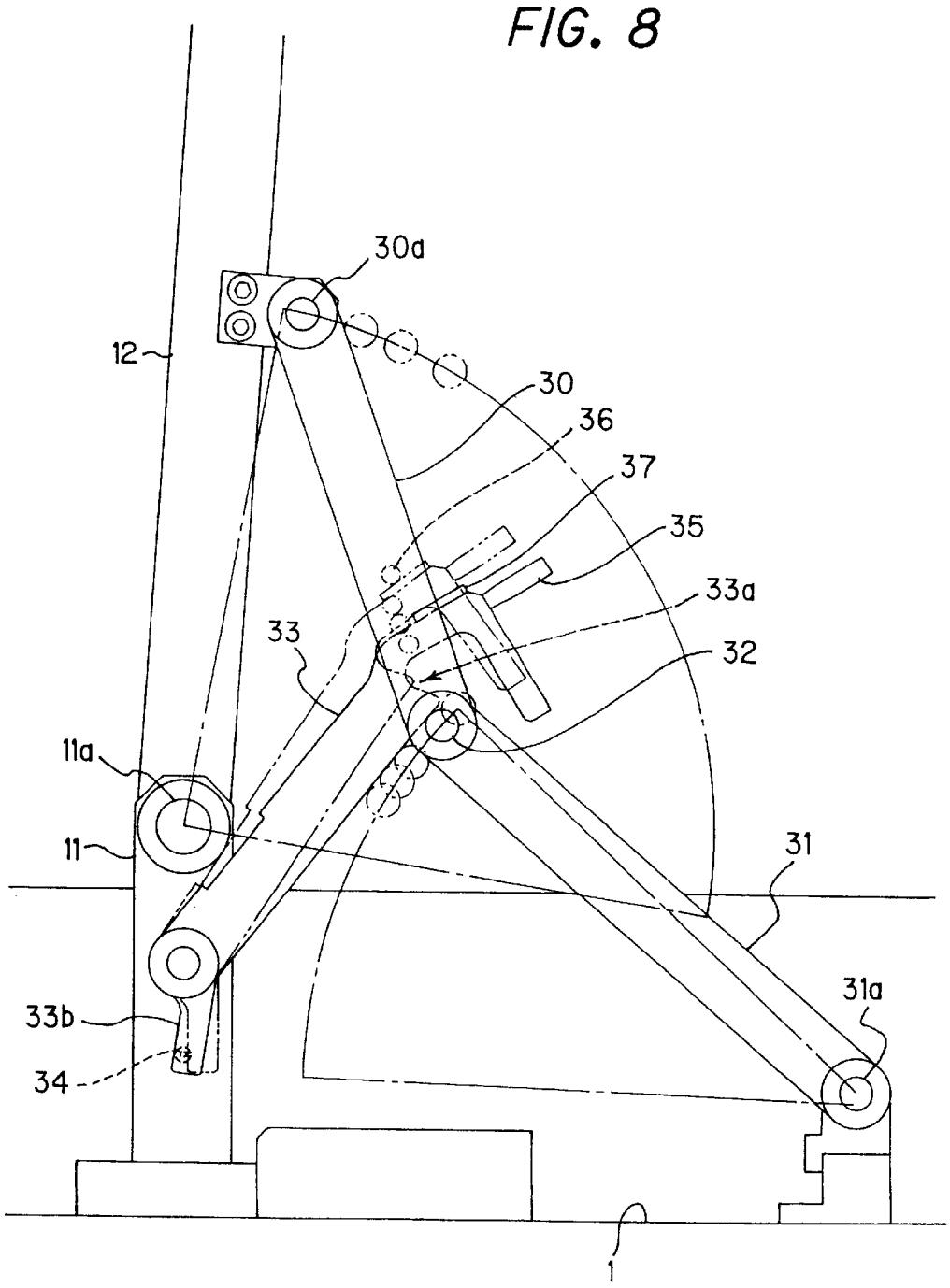
FIG. 8 is a view for explaining a case where the condition shown in FIG. 7 is to be returned to the condition shown in FIG. 6.

First Embodiment:

A first embodiment of a printing press according to the present invention will next be described with reference to FIGS. 1 to 8. FIG. 1 is a schematic view showing the configuration of a main portion of the embodiment. FIG. 2 is a view as viewed along the arrow II of FIG. 1. FIG. 3 is a view as viewed along the arrow III of FIG. 2. FIG. 4 is an enlarged view of a portion of FIG. 1 indicated by the arrow IV of FIG. 1. FIG. 5 is a view as viewed along the arrow V of FIG. 4. FIG. 6 is a view for explaining a case where a plate cylinder and a blanket cylinder are to undergo maintenance or inspection. FIG. 7 is a view for explaining a case where an inking unit and a dampening unit are to undergo maintenance or inspection. FIG. 8 is a view for explaining a case where the condition shown in FIG. 7 is to be returned to the condition shown in FIG. 6.

As shown in FIG. 1, a plate cylinder 2 is disposed within right-hand and left-hand main frames 1 of the printing press. A blanket cylinder 3 abuts the plate cylinder 2 from underneath. A group of rollers 4 of an inking unit and of a dampening unit are disposed above the plate cylinder 2 while abutting the plate cylinder 2 and one another.

As shown in FIGS. 1 and 2, a support member 11 is vertically disposed on an upper portion of the left-hand or right-hand main frame 1 located at one side of an axial direction of the cylinders 2 and 3. Another support member 11 is also provided on another main frame 1 (not shown) opposing the main frame 1. L-shaped support arms 12, which serve as the first movable member, are connected to the corresponding support members 11 in the following manner. The base end of each support arm 12 is connected to the upper end of the corresponding support member 11 via a pivot pin 11*a* in such a manner as to be swingable about an axis in parallel with the axes of the cylinders 2 and 3. Thus, the support arm 12 can be swung such that the distal end thereof are moved between a lower position, which serves as the first position, and an upper position, which serves as the second position.

At a distal end of each of the support arms 12, one end of a support frames 13 is swingably supported via a pivot pin 12*a*. Thus, when the distal end portion of the support arm 12 is situated at the lower position (first position), the support frame 13 can be moved between a position (third position) at which the other end portion thereof faces downward, and a position (fourth position) at which the other end portion thereof faces upward.

A plate-replacing device 14, which serves as the plate-replacing means and adapted to mount a plate onto and demount a plate from the plate cylinder 2, and a cover plate 15 are attached to the support frames 13. When the distal end portion of the support arm 12 is situated at the lower position (first position), and the other end portion of the support frame 13 is situated at the lower position (third position), the plate-replacing device 14 and the cover plate 15 cover at least a portion of a space between the paired main frames 1. When the other end portion of the support frame 13 is situated at the upper position (fourth position) or when the distal end portion of the support arm 12 is situated at the upper position (second position), the space between the paired main frames 1 can be opened.

In the present embodiment, the support frames 13, the plate-replacing device 14, the cover plate 15, etc. constitute the second movable member. Also, the support arms 12, which serve as the first movable member, and the second movable member serve as movable members.

A connection pin 16 extends through the distal end portion of the support arm 12 in such a manner as to be movable along the axial direction of the cylinders 2 and 3. A force is applied to the connection pin 16 by a spring, etc, towards the main frame 1, such that an end of the connection pin 16 is projected from the support arm 12. A connection member 17, with which the connection pin 16 is disengageably engaged, is attached to the main frame 1.

Through insertion of the connection pin 16 into the connection member 17, swinging of the support arm 12 is restricted. Through removal of the connection pin 16 from the connection member 17, the support arm 12 can swing about the base end thereof.

A connection device 18 is provided at the other end portion of the support frame 13. Through rotation of a knob 18*a*, a pin 18*b* of the connection device 18 projects toward or retracts away from the main frame 1. A connection member 19, with which the pin 18*b* is disengageably engaged, is attached to the main frame 1.

When the pin 18*b* is inserted into the connection member 19 by rotating the knob 18*a*, swinging of the support frame 13 is restricted. By removing the pin 18*b* of the connection device 18 from the connection member 19, the support frame 13 can swing about one end thereof located at the distal end portion of the support arm 12.

As shown in FIGS. 1 to 3, a support shaft 21 is rotatably attached to the main frame 1 via brackets 20 such that the axis thereof is in the direction of the axes of the cylinders 2 and 3. The support shaft 21 is positioned such that, when the connection pin 16 is engaged with the connection member 17, the axis thereof is aligned with that of the pivot pin 12*a*. Base ends of swing arms 22, which serve as the swing member, are connected to and supported by the support shaft 21. The swing arms 22 can be moved between a position (fifth position) at which the distal ends thereof face downward, and a position (sixth position) at which the distal ends thereof face upward.

A support beam 23 is provided in a standing condition on the main frame 1 at a position below the support shaft 21. One end portion of gas springs 24, which serves as the force application means, are swingably connected to a distal end portion of the support beam 23. The other end portions of the gas springs 24 are swingably connected to the corresponding swing arms 22 at positions biased toward the support shaft 21.

When the longitudinal axis of the swing arm 22 extends along the vertical direction, the gas spring 24 applies a force to the corresponding swing arm 22 such that the distal end portion of the swing arm 22 is caused to face downward (toward the fifth position). When the longitudinal axis of the swing arm 22 intersects the vertical direction at a predetermined or greater angle, the gas spring 24 applies a force to the swing arm 22 such that the distal end portion of the swing arm 22 is caused to face upward (toward the sixth position) beyond the bottom dead center.

An engagement pin 25 is provided in a standing condition on a surface of the support frame 13 which is located outside in the axial direction of the cylinders 2 and 3; i.e., which faces the swing arm 22. An engagement member 26 is provided on the swing arms 22 in such a standing condition as to project inward in the axial direction of the cylinders 2 and 3; i.e., in such a standing condition as to project toward the support frame 13. A U-shaped engagement groove 26*a* is formed in the engagement member 26 for removable engagement with the engagement pin 25. The engagement member 26 is oriented such that an opening of the U-shaped engagement groove 26*a* faces in the same direction as does the distal end of the swing arm 22.

That is, when the other end portion of the support frame 13 is situated at the lower position (third position), the engagement member 26 is oriented such that the opening of the engagement groove 26*a* faces downward. When the other end portion of the support frame 13 is situated at the upper position (fourth position), as the swing arm 22 is swung, the orientation of the engagement member 26 changes such that the opening of the engagement groove 26*a* faces upward (moving direction of the support arm 12 from the first position to the second position).

In the present embodiment, the engagement pin 25, the engagement member 26, etc. constitute the connection means.

As shown in FIGS. 1 and 2, the base end of a support plate 27 is swingably connected to the support arm 12 at an intermediate position between the base end and the distal end of the support arm 12. An engagement hole 27*a* is formed at the distal end of the support plate 27.

When the support frame 13 is swung about the pivot pin 12*a* to move the other end portion thereof upward, the support plate 27 is swung to bring the distal end of the support plate 27 close to the other end portion of the support frame 13. Then, the pin 18*b* of the connection device 18 is inserted into the engagement hole 27*a* formed in the support plate 27, to thereby fixedly hold the other end portion of the support frame 13 by means of the support arm 12 via the support plate 27 (see FIG. 6).

Notably, in FIGS. 1 and 2, reference numeral 28 denotes a stopper pin provided on the support arm 12 in a standing condition for the purpose of restricting swinging of the support plate 27; and reference numeral 29 denotes a plunger attached to the support arm 12 and adapted to hold the support plate 27 at a position where further swinging of the support plate 27 is restricted by means of the stopper pin 28.

As shown in FIGS. 1, 4, and 5, one end portion of a first link plate 30, which serves as a first link member, is swingably connected, via a pivot pin 30*a*, to the support arm 12 at a position biased toward the base end of the support arm 12. One end portion of a second link plate 31, which serves as a second link member, is swingably connected to the other end portion of the first link plate 30 via a connection pin 32. The other end portion of the second link plate 31 is connected to an upper portion of the main frame 1 via a pivot pin 31*a*. A base end portion of a support lever 33 is swingably connected to the support member 11. An engagement groove 33*a* is formed at a distal end portion of the support lever 33. The engagement groove 33*a* serves as an engagement portion of the support lever 33 which can be disengageably engaged with the circumferential surface of an axial end portion of the connection pin 32 which acts as a protruding portion.

When the support arm 12 is swung about the pivot pin 11*a* to move the distal end portion of the support arm 12 from the lower position (first position) to the upper position (second position), the distance between one end of the first link plate 30 and the other end of the second link plate 31 increases, while the connection pin 32 moves upward. As a result, the circumferential surface of the axial end portion (protruding portion) of the connection pin 32 comes into contact with the edge surface of a lower portion of the support lever 33, and slides along the edge surface, while swinging the support lever 33 such that the distal end of the support lever 33 moves upward. Subsequently, the axial end portion of the connection pin 32 enters the engagement groove 33*a* formed in the support lever 33. Thus, the support lever 33 holds the support arm 12 while maintaining the distal end portion of the support arm 12 at the upper position (second position) via the connection pin 32, the link plates 30 and 31, and the pivot pins 30*a* and 31*a* (see FIGS. 4 and 7).

According to the present embodiment, the first link plate 30, the second link plate 31, the connection pin 32, etc. constitute a link member, whereas the axial end portion (protruding portion) of the connection pin 32, the engagement groove 33*a* (engagement portion) formed in the support lever 33, etc. constitute the engagement means.

A plunger 34 is attached to the support member 11. An extended portion 33*b*, adapted to engage the plunger 34, is formed at the base end portion of the support lever 33. A handle 35 is attached to the distal end of the support lever 33.

When the support lever 33 is swung, by means of the handle 35, to move the distal end portion of the support lever 33 further upward while the support lever 33 holds the support arm 12 via the connection pin 32, etc., the connection pin 32 is disengaged from the engagement groove 33*a*, formed in the support lever 33, to thereby release the support arm 12. At the same time, the extended portion 33*b* of the support lever 33 moves over the plunger 34 to be thereby held by the plunger 34. Thus, the support lever 33 can be held at that position (see FIG. 8).

According to the present embodiment, the extended portion 33*b*, the plunger 34, etc. constitute holder means.

A presser pin 36 is provided on the link plate 30 in a standing condition at a position between the opposite ends of the link plate 30. A rest plate 37 that abuts the presser pin 36 is attached to a distal end portion of the support lever 33.

When the support arm 12 is swung to move the distal end portion of the support arm 12 from the upper position (second position) to the lower position (first position) while the plunger 34 is holding the extended portion 33*b* of the support lever 33, swinging of the support arm 12 causes the presser pin 36 to move downward via the pivot pin 30*a* and the link plate 30. The presser pin 36 abuts the rest plate 37 and then presses the distal end portion of the support lever 33 downward via the rest plate 37. The extended portion 33*b* of the support lever 33 moves over the plunger 34 to be thereby released from hold effected by the plunger 34. As a result, the support lever 33 can be swung in cooperation with swinging of the support arm 12 (see FIG. 8).

According to the present embodiment, the presser pin 36, the rest plate 37, etc. constitute release means.

The thus-configured printing press undergoes maintenance or inspection of printing means provided in the lower position of the printing press, such as the plate cylinder 2 and the blanket cylinder 3, in the following manner. The knob 18*a* of the connection device 18 is rotated to thereby disengage the pin 18*b* from the connection member 19. Subsequently, the support frame 13 is swung to move the other end portion thereof from the lower position (third position) to the upper position (fourth position). As a result, the swing arms 22 are swung via the engagement pin 25 and the engagement member 26 such that the distal ends thereof move from the lower position (fifth position) to the upper position (sixth position).

At the initial stage, the gas springs 24 apply force to the corresponding swing arms 22 in such a manner as to resist swinging of the support frame 13. However, when the swing arms 22 are swung to such a degree that the gas springs 24 move beyond the bottom dead centers thereof, the gas springs 24 begin to apply a force to the corresponding swing arms 22 in such a manner as to assist swinging of the support frame 13.

After the support frame 13 is swung to move the other end portion thereof to the upper position (fourth position), the support plate 27 is swung to be disengaged from the plunger 29. The knob 18*a* of the connection device 18 is rotated to engage the pin 18*b* with the engagement hole 27*a* formed in the support plate 27. Thus, the support frame 13 can be held in place while the other end portion thereof is situated at the upper position (see FIG. 6).

Thus, the other end portion of the support frame 13 can be easily situated at the upper position, thereby enabling establishment of an open space around the plate cylinder 2 and the blanket cylinder 3 with use of a little labor.

Subsequently, upper printing means, such as the group of rollers 4 of an inking unit, a dampening unit, and the like, can undergo maintenance or inspection in the following manner. The connection pin 16 is disconnected from the connection member 17. The support arm 12 is swung about the pivot pin 11*a* to move the distal end portion thereof to the upper position (second position). Since the swing arms 22 are swung such that the distal end portions thereof are situated at the upper position (sixth position), the engagement member 26 is oriented such that the opening of the engagement groove 26*a* faces upward (moving direction of the support arm 12 from the first position to the second position). Thus, the engagement pin 25 is disengaged from the engagement groove 26*a* formed in the engagement member 26. In this manner, movable members, such as the support frame 13, the plate-replacing device 14, and the cover plate 15, can be moved above the main frame 1 (see FIG. 7).

As the support arm 12 is swung, as mentioned above, the connection pin 32 is caused, via the pivot pins 30*a*, 31*a* and the link plates 30, 31, to rise along an acute path, thereby lifting the support lever 33 and then causing the connection pin 32 to engage with the engagement groove 33*a* formed in the support lever 33. Thus, the support arm 12 can be fixedly held in place (fourth position) via the pivot pins 30*a*, 31*a*, the link plates 30, 31, the connection pin 32, and the support lever 33.

Thus, the movable members can be easily moved above the main frame 1, thereby facilitating maintenance or inspection of the upper printing means. Also, the movable members can be fixedly held at a predetermined position in an automatic manner, simultaneously with the operation of moving the movable members above the main frame 1. Therefore, preparatory work for maintenance or inspection can be simplified, thus enhancing work efficiency.

When maintenance or inspection work is completed, the handle 35 is lifted to thereby swing the support lever 33 upward. The connection pin 32 is disengaged from the engagement groove 33*a*, formed in the support lever 33, and the extended portion 33*b* of the support lever 33 is moved over the plunger 34 to be thereby held by the plunger 34. Accordingly, the support lever 33 is held at the position (hold-canceling position). Thus, the support arm 12 can be swung to move the distal end portion thereof downward, to thereby be returned to the initial state thereof.

As the distal end portion of the support arm 12 moves from the upper position (second position) to the lower position (first position), the presser pin 36 moves downward to thereby press down the distal end portion of the support lever 33 via the rest plate 37. Since the extended portion 33*b* of the support lever 33 is moved over the plunger 34 to be thereby released from hold effected by the plunger 34, the support lever 33 can be swung simultaneously with movement of the support arm 12. Thus, the support lever 33 can be automatically returned to the initial state thereof.

Additionally, through performance of reverse operation of the aforementioned preparatory work, all members can be returned to the initial state thereof.

Since the above-described printing press facilitates movement of movable members over a wide range, an open space can be established even around upper printing means, such as an inking unit and a dampening unit, thereby facilitating maintenance or inspection of the upper printing means.

Also, when the other end portion of the support frame 13 is moved from the lower position (third position) to the upper position (fourth position), the gas springs 24 exerts force in such a manner as to assist movement of the support frame 13. Thus, even a heavy movable member, such as the plate-replacing device 14, can be easily moved, thereby greatly reducing burden on a worker.

Since movable members can be fixedly held at a predetermined position automatically, simultaneously with the operation of moving the movable members above the main frame 1, preparatory work for maintenance or inspection can be simplified, thus enhancing work efficiency.

Through lifting the handle 35 to thereby swing the support lever 33 upward, the connection pin 32 is disengaged from the engagement groove 33*a* formed in the support lever 33, and the extended portion 33*b* of the support lever 33 is moved over the plunger 34 to be thereby held by the plunger 34. Accordingly, the support arm 12 can be easily swung to move the distal end portion thereof downward, whereby the support arm 12 can be easily returned to the initial state thereof.

As the distal end portion of the support arm 12 moves from the upper position to the lower position, the presser pin 36 moves downward to thereby press down the distal end portion of the support lever 33 via the rest plate 37. Since the extended portion 33*b* of the support lever 33 is moved over the plunger 34 to be thereby released from hold effected by the plunger 34, the support lever 33 can be swung simultaneously with the movement of the support arm 12. Thus, the support lever 33 can be automatically returned to the initial state thereof.

Figure 9:
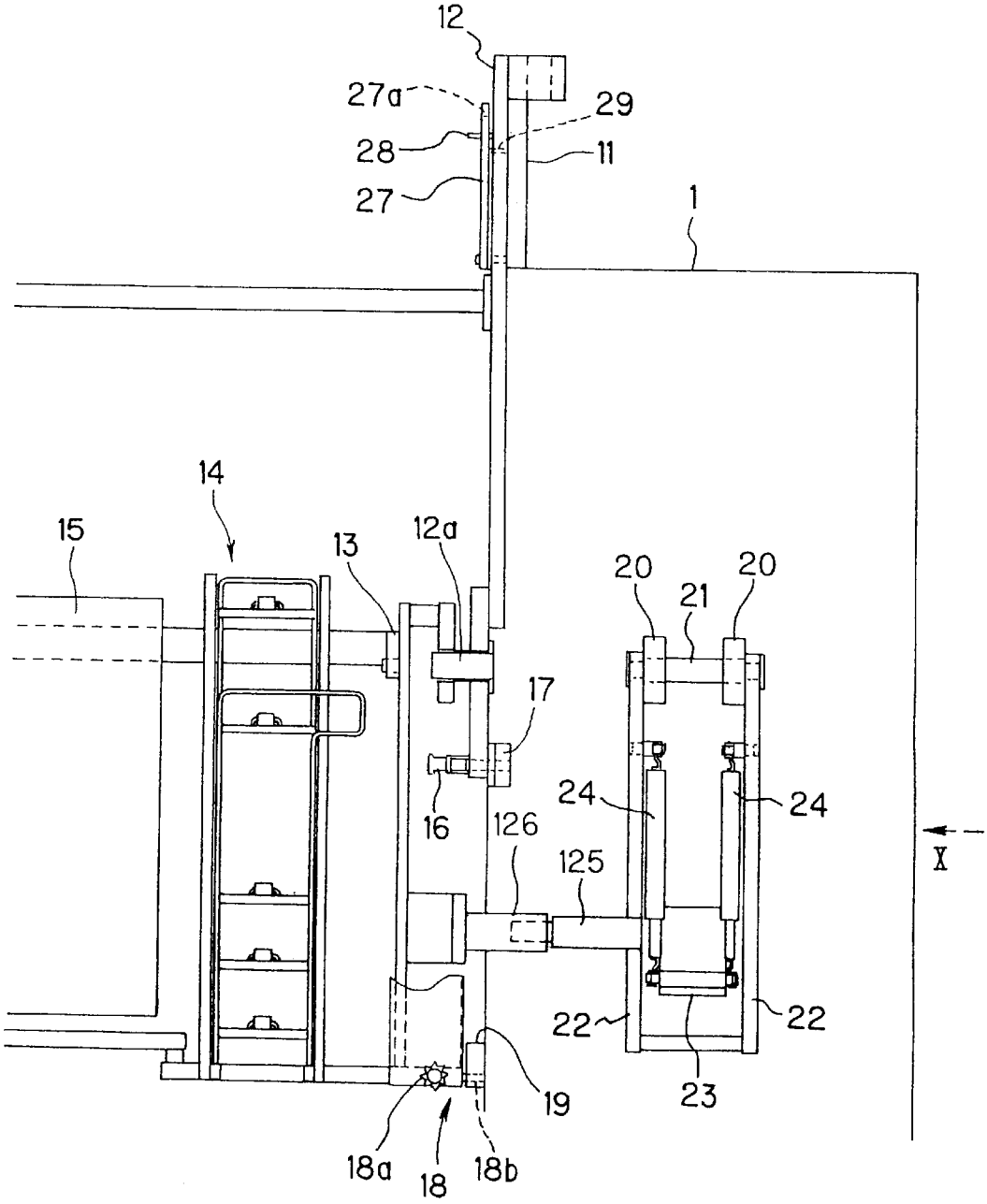
FIG. 9 is a schematic view showing the configuration of a main portion of the embodiment.
Figure 10:
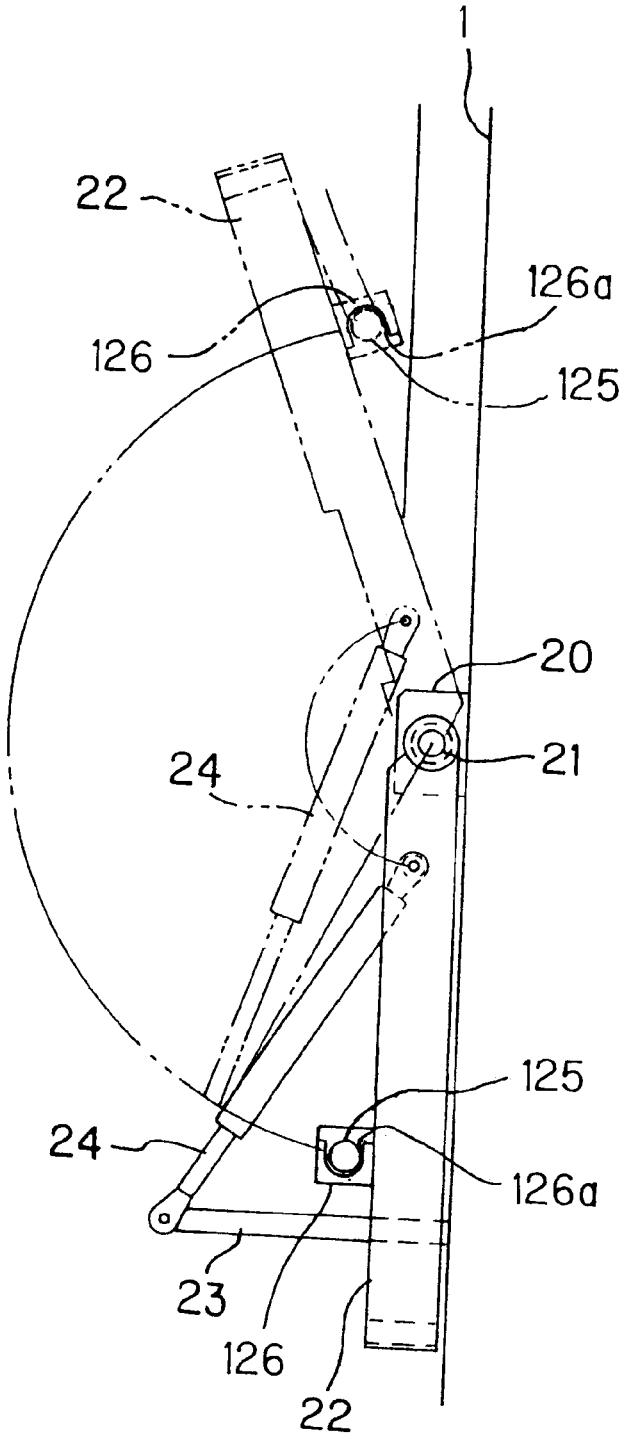
FIG. 10 is a view as viewed along the arrow X of FIG. 9.
Figure 11:
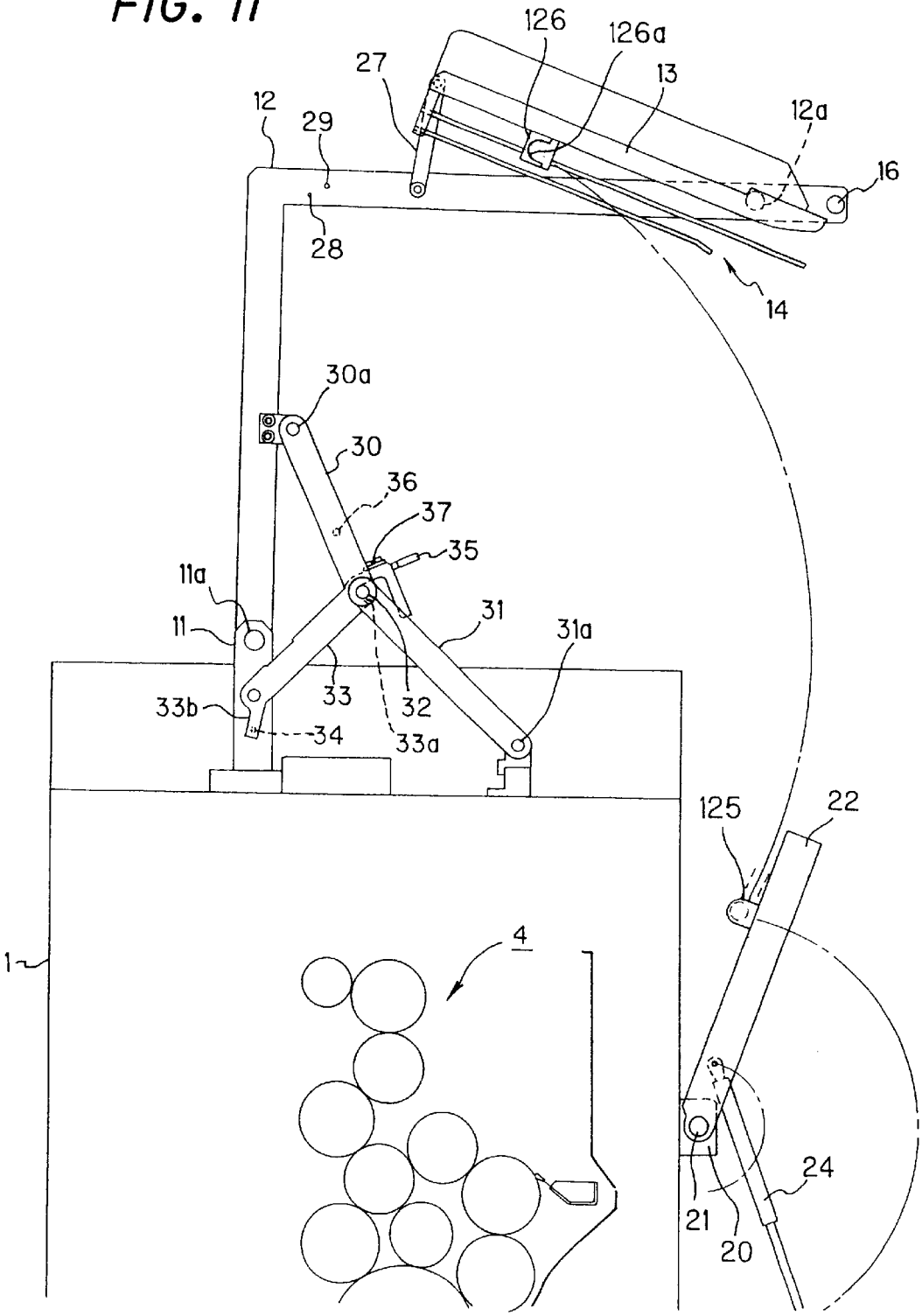
FIG. 11 is a view for explaining a case where an inking unit and a dampening unit are to undergo maintenance or inspection.

Second Embodiment:

A second embodiment of a printing press according to the present invention will next be described with reference to FIGS. 9 to 11. FIG. 9 is a schematic view showing the configuration of a main portion of the embodiment. FIG. 10 is a view as viewed along the arrow X of FIG. 9. FIG. 11 is a view for explaining a case where an inking unit and a dampening unit are to undergo maintenance or inspection. Features common to those of the above-described first embodiment are denoted by common reference numerals, and repeated description thereof is omitted.

As shown in FIGS. 9 and 10, an engagement pin 125 is provided on the swing arm 22 in such a standing condition as to project inward in the axial direction of the cylinders 2 and 3; i.e., in such a standing condition as to project toward the support frame 13. An engagement member 126 is provided in a standing condition on a surface of the support frame 13 which is located outside in the axial direction of the cylinders 2 and 3; i.e., which faces the swing arm 22. A U-shaped engagement groove 126*a* is formed in the engagement member 126 for removable engagement with the engagement pin 125. The engagement member 126 is oriented such that an opening of the U-shaped engagement groove 126*a* faces the same direction as the base end of the swing arm 22.

That is, when the other end portion of the support frame 13 is situated at the lower position (third position), the engagement member 126 is oriented such that the opening of the engagement groove 126*a* faces upward. When the other end portion of the support frame 13 is situated at the upper position (fourth position), as the swing arm 22 is swung, the orientation of the engagement member 126 changes such that the opening of the engagement groove 126*a* faces downward (in the direction along which the support arm 12 moves from the second position to the first position).

According to the aforementioned first embodiment, the engagement pin 25 is provided on the support frame 13, and the engagement member 26 is provided on the swing arm 22. By contrast, according to the present embodiment, the engagement pin 125 is provided on the swing arm 22, and the engagement member 126 is provided on the support frame 13. In the present embodiment, the engagement pin 125 and the engagement member 126 essentially constitute the connection means.

In the present embodiment, as in the case of the aforementioned first embodiment, upper printing means, such as the group of rollers 4 of an inking unit, a dampening unit, and the like, can undergo maintenance or inspection in the following manner. The support arm 12 is swung about the pivot pin 11*a* to move the distal end portion thereof to the upper position (second position). Since the swing arms 22 are swung such that the distal end portions thereof are situated at the upper position (fourth position), the engagement member 126 is oriented such that the opening of the engagement groove 126*a* faces downward (in the direction along which the support arm 12 moves from the second position to the first position). Thus, the engagement pin 125 is disengaged from the engagement groove 126*a* formed in the engagement member 126. In this manner, movable members, such as the support frame 13, the plate-replacing device 14, and the cover plate 15, can be moved above the main frame 1 (see FIG. 11).

Accordingly, the present embodiment also yields actions and effects similar to those yielded by the first embodiment.

Other Embodiments:

In the above embodiments, the plate-replacing device 14, for mounting a plate onto the plate cylinder 2 and demounting a plate from the plate cylinder 2 is attached to the support frame 13. However, in place of the plate-replacing device 14, plate-replacing means for at least one of mounting a plate onto the plate cylinder 2 and demounting a plate from the plate cylinder 2 may be attached to the support frame 13.

Further, in the above embodiments, an end portion of the connection pin 32, for connecting the first link plate 30 and the second link plate 31, is engaged with the engagement groove 33*a* formed in the support lever 33. An effect similar to that yielded by the present embodiment can be yielded so long as a protruding portion that engages with an engagement portion of a support lever is provided on a first link plate or a second link plate. However, the engagement mechanism of the present embodiment is preferred, since the number of members (parts) can be reduced. Also, a function similar to that of the above embodiments can be obtained by providing a protruding portion on the support lever and providing an engagement groove (engagement portion) in a link member, and yields an effect similar to that yielded by the present embodiment.

The printing press of the present invention facilitates movement of movable members over a wide range; thus, an open space can be established even around upper printing means, such as an inking unit and a dampening unit, thereby facilitating maintenance or inspection of the upper printing means.

Also, when the second movable member is moved from the third position to the fourth position, the force application means exerts force in such a manner as to assist movement of the second movable member. Thus, even when the second movable member is heavy, the second movable member can be easily moved, thereby greatly reducing burden on a worker.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A printing press, comprising:

a first movable member swingably supported by a main frame such that said first movable member can move between a first position and a second position; and a second movable member swingably supported by said first movable member such that said second movable member can move between a third position and a fourth position;

force application means for applying a force to said second movable member in such a direction as to move said second movable member toward said fourth position; and connection means disposed between said second movable member and said force application means, said connection means being adapted to connect said second movable member and said force application means when said second movable member moves between said third position and said fourth position, and disconnect said second movable member and said force application means from each other when said first movable member moves between said first position and said second position.

2. A printing press according to claim 1, further comprising:

a swing member swingably provided on said main frame such that said swing member can move between a fifth position and a sixth position while establishing connection between said connection means and said force application means.

3. A printing press according to claim 2, wherein said connection means includes, an engagement member having an engagement groove, and an engagement pin engaged with said engagement groove of said engagement member.

4. A printing press according to claim 3, wherein said engagement pin is attached to said second movable member, and said engagement member is attached to said swing member, and said engagement groove of said engagement member is formed such that, when said swing member is situated at said sixth position, said engagement groove opens toward a moving direction of said first movable member from said first position to said second position.

5. A printing press according to claim 3, wherein said engagement pin is attached to said swing member, and said engagement member is attached to said second movable member, and said engagement groove of said engagement member is formed such that, when said swing member is situated at said sixth position, said engagement groove opens toward a moving direction of said first movable member from said second position to said first position.

6. A printing press according to claim 1, wherein said second movable member includes plate-replacing means for performing at least one of mounting of a plate onto a plate cylinder and demounting of a plate from said plate cylinder.

7. A printing press according to claim 1, further comprising:

a first connection member provided on one of said main frame and said first movable member; and a connection pin provided on the other of said main frame and said first movable member, said connection pin being disengageably engaged with said first connection member so as to restrict swinging of said first movable member relative to said main frame.

8. A printing press according to in claim 1, further comprising:

a second connection member provided on one of said main frame and said second movable member; and a connection device provided on the other of said main frame and said second movable member, said connection device being disengageably engaged with said second connection member to restrict swinging of said second movable member relative to said main frame.

9. A printing press according to claim 1, further comprising:

a support plate whose base end side is swingably connected to one of said first movable member and said second movable member and which has an engagement hole formed at a distal end side; and a connection device provided on the other of said first movable member and said second movable member, said connection device being disengageably engaged with said engagement hole of said support plate to restrict swinging of said second movable member relative to said first movable member.

10. A printing press according to claim 1, further comprising:

first connection means provided on said main frame;

a support plate whose base end side is swingably connected to said first movable member and which has second connection means at a distal end side; and third connection means provided on said second movable member, said third connection means being selectively connectable with said first connection means and said second connection means, wherein said third connection means and said first connection means are connected to each other to restrict swinging of said second movable member relative to said main frame, and said third connection means and said second connection means are connected to each other to restrict swinging of said second movable member relative to said first movable member.

* * * * *

UNITED STATES PATENT AND TRADEMARK OFFICE

CERTIFICATE OF CORRECTION

PATENT NO. : 6,386,101 B2
DATED : May 14, 2002
INVENTOR(S) : Kenji Tobe et al.

It is certified that error appears in the above-identified patent and that said Letters Patent is hereby corrected as shown below:

Title page,
Item [30], Foreign Application Priority Data, please correct the priority date from "12-144887" to -- 2000-144887 --.

Signed and Sealed this

Thirty-first Day of December, 2002

JAMES E. ROGAN
*Director of the United States Patent and Trademark Office*